US007277107B2

(12) United States Patent
Kopf et al.

(10) Patent No.: US 7,277,107 B2
(45) Date of Patent: Oct. 2, 2007

(54) IMAGE-FORMING APPARATUS

(75) Inventors: Dale R. Kopf, Middleton, ID (US); Mark W. Wright, Nanpa, ID (US); Riyadth F. Al-Kazily, Star, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 331 days.

(21) Appl. No.: 10/916,690

(22) Filed: Aug. 12, 2004

(65) Prior Publication Data

US 2006/0033938 A1 Feb. 16, 2006

(51) Int. Cl.
*B41J 2/44* (2006.01)

(52) U.S. Cl. ..... 347/136

(58) Field of Classification Search ..... 347/129–130, 347/134–136, 239, 255
See application file for complete search history.

(56) References Cited

U.S. PATENT DOCUMENTS

| | | | | |
|---|---|---|---|---|
| 4,357,625 | A | 11/1982 | Lamberts et al. | |
| 4,595,259 | A | 6/1986 | Perregaux | |
| 4,636,817 | A | 1/1987 | Masaki | |
| 4,639,608 | A | 1/1987 | Kuroda | |
| 4,651,176 | A | 3/1987 | Yamakawa et al. | |
| 4,763,142 | A | 8/1988 | Saitoh et al. | |
| 4,783,146 | A | 11/1988 | Stephany et al. | |
| 5,011,271 | A | 4/1991 | Saito et al. | |
| 5,162,919 | A | 11/1992 | Ono | |
| 5,260,718 | A | 11/1993 | Rommelmann et al. | |
| 5,325,228 | A | 6/1994 | Matsubara et al. | |
| 5,519,240 | A | 5/1996 | Suzuki | |
| 5,548,423 | A | 8/1996 | Natsunaga | |
| 5,812,176 | A | 9/1998 | Kawabe et al. | |
| 5,844,588 | A | 12/1998 | Anderson | |
| 6,195,114 | B1 | 2/2001 | Fujita | |
| 6,366,338 | B1 | 4/2002 | Masubuchi et al. | |
| 6,414,705 | B1 | 7/2002 | Yamada et al. | |
| 6,504,566 | B1 | 1/2003 | Yamada et al. | |
| 6,545,696 | B1 | 4/2003 | Yamada et al. | |
| 6,600,474 | B1 | 7/2003 | Heines et al. | |
| 2002/0054203 | A1 | 5/2002 | Yamada et al. | |
| 2002/0071132 | A1 | 6/2002 | Yamada et al. | |
| 2004/0080484 | A1* | 4/2004 | Heines et al. | 345/108 |
| 2005/0088404 | A1* | 4/2005 | Heines et al. | 345/108 |

OTHER PUBLICATIONS

Flixel Reveals New MEMS Display, Projection Monthly, Jul. 14, 2003, www.insightmedia.info/news (2 pgs.).
"Electronic Slide" Technology, Flixel Ltd., www.flixel.com (1 pg.).
Technology, Flixel Ltd., www.flixel.com/technology (1 pg.).
Typical Applications, Flixel Ltd., www.flixel.com/applications (2pgs.).

* cited by examiner

*Primary Examiner*—Huan Tran

(57) ABSTRACT

An image-forming apparatus includes one or more shutters that selectively permit passage of light.

49 Claims, 5 Drawing Sheets

FIG. 3
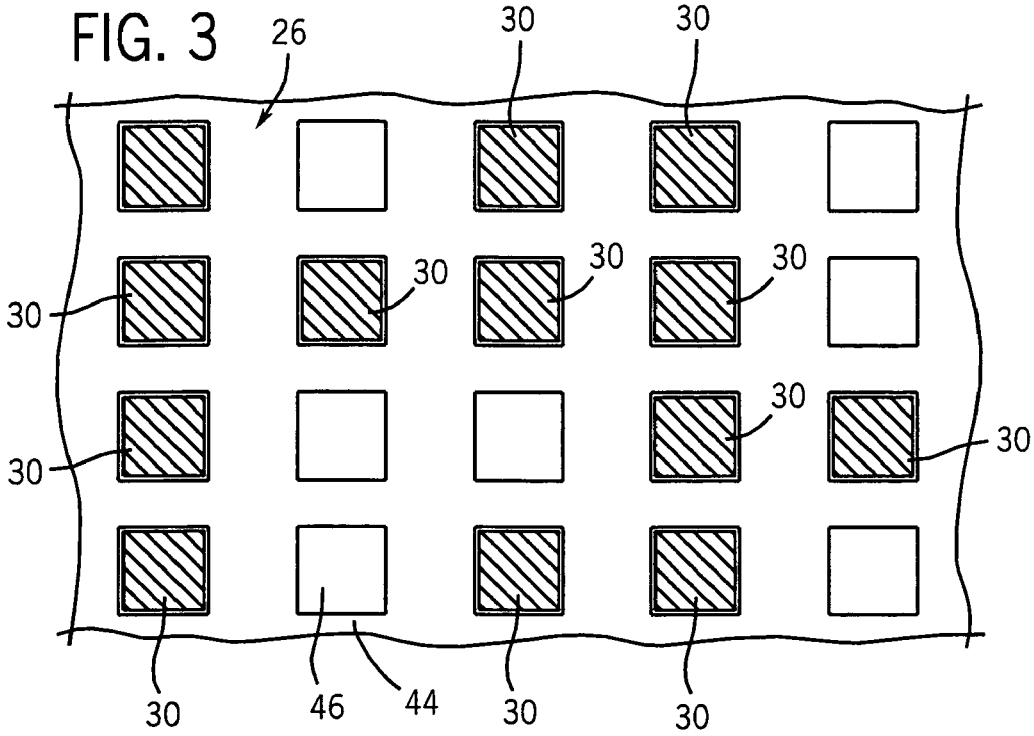
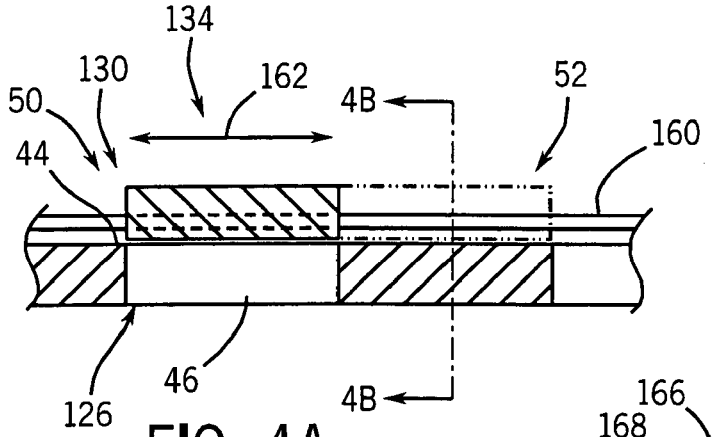
FIG. 4A
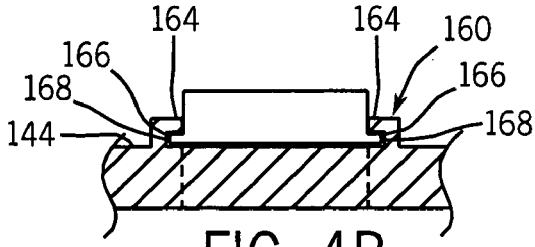
FIG. 4B
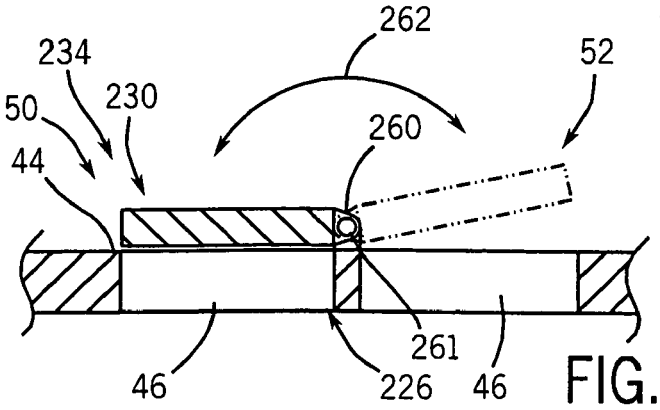
FIG. 5

FIG. 7
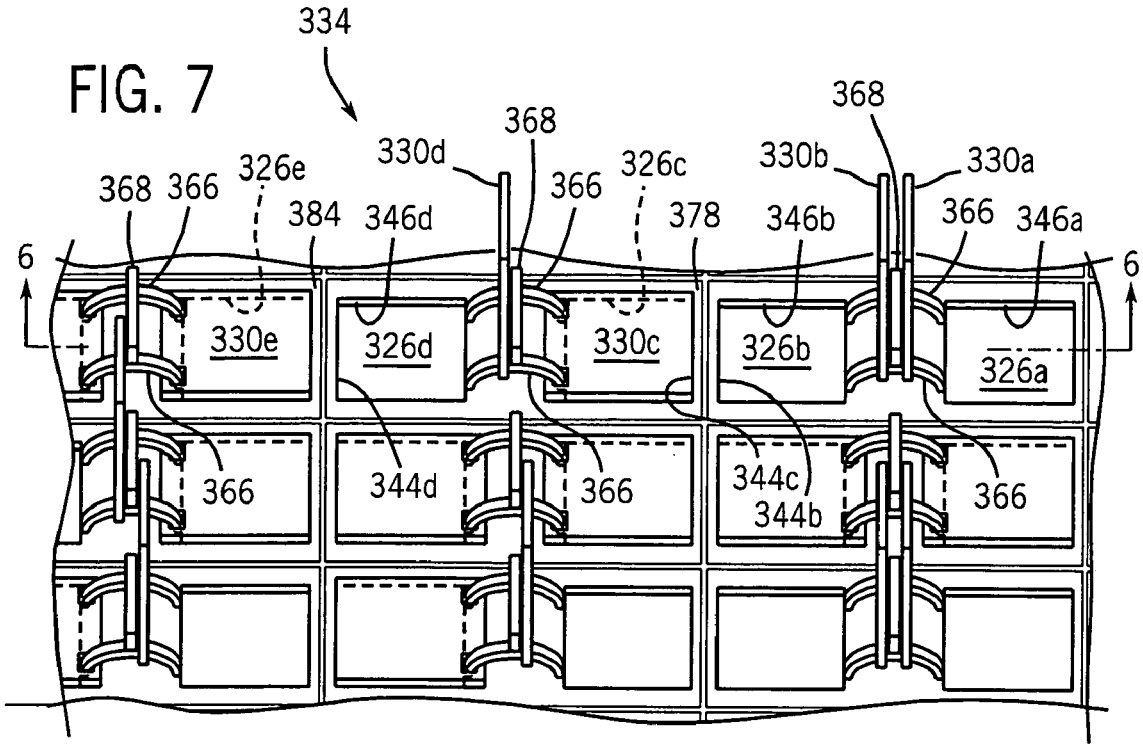
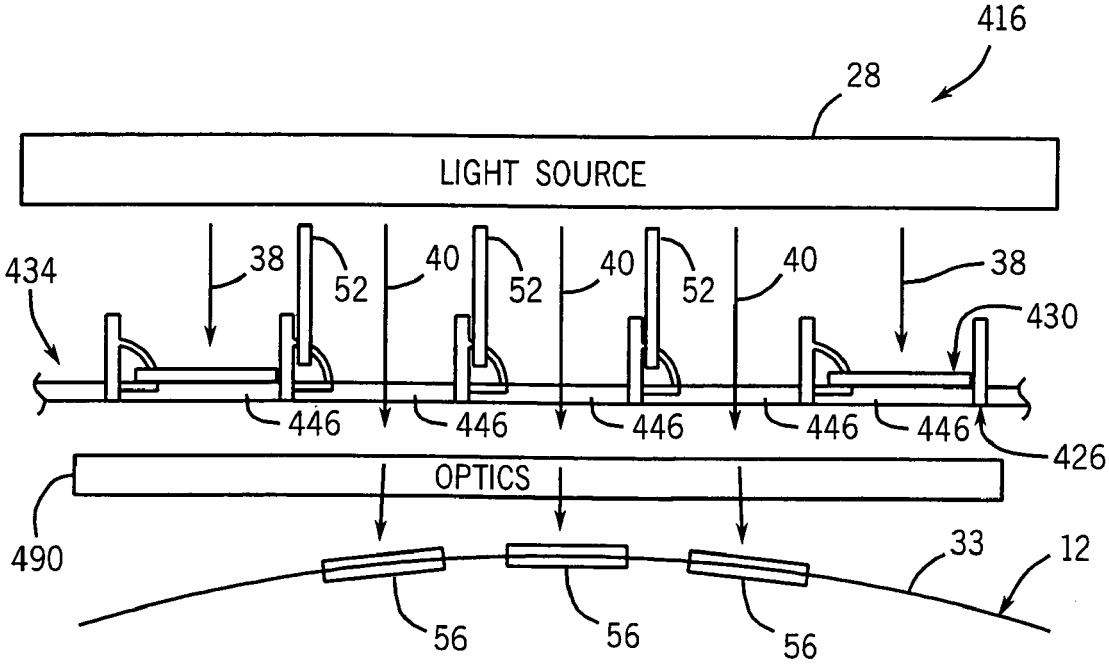
FIG. 8

FIG. 9
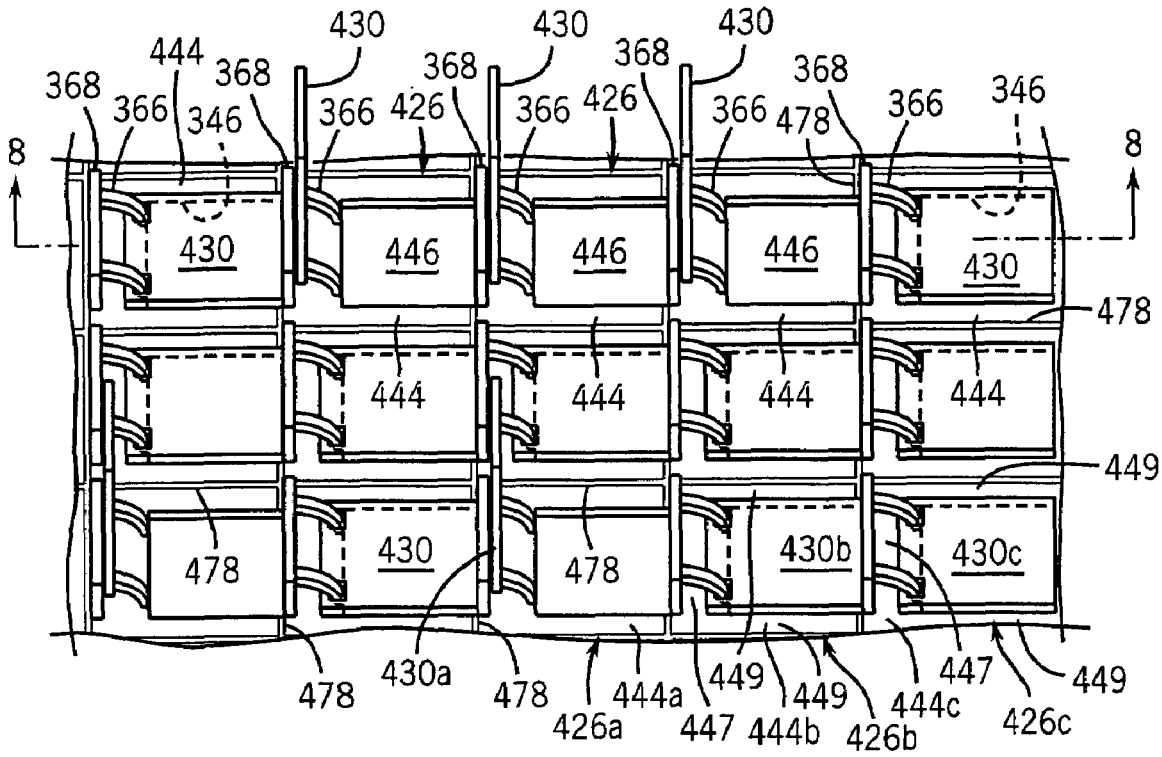
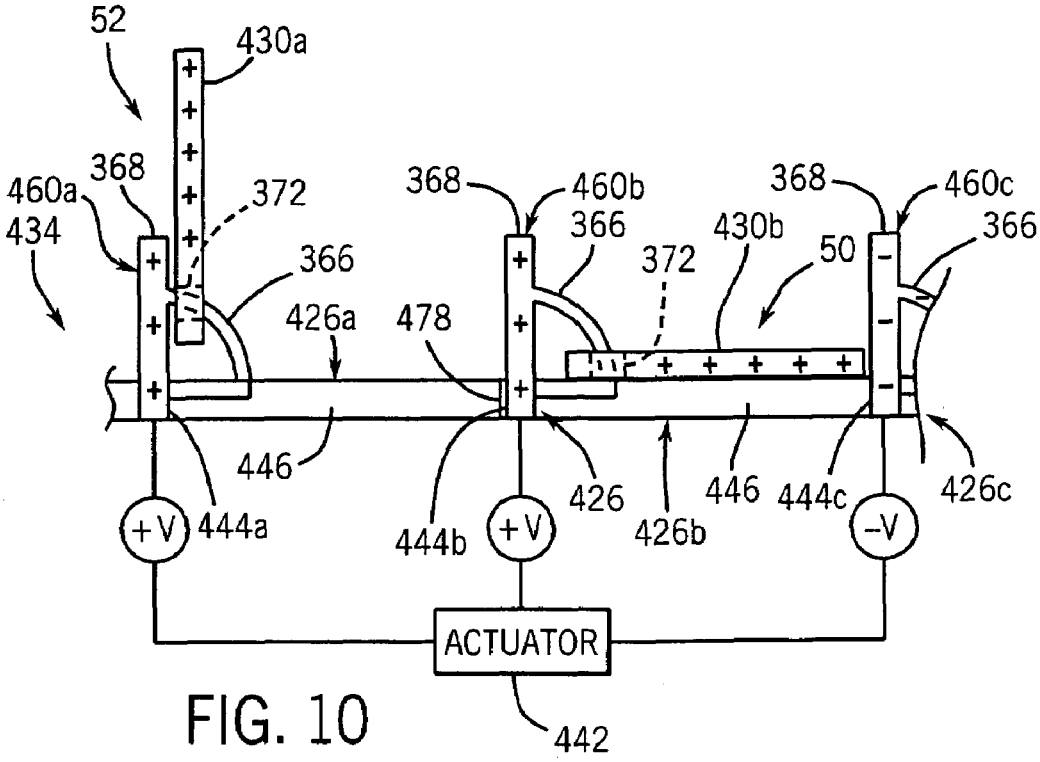
FIG. 10

IMAGE-FORMING APPARATUS

BACKGROUND

Electrophotographic systems are commonly used to form images upon print media. Electrophotographic systems that utilize a laser and spinning mirror to form an image upon a photoconductive member one line at a time, often employ complicated optics and may be noisy. Electrophotographic systems that utilize liquid crystal members often use polarized light and may be slow in changing between transmissivity states.

BRIEF DESCRIPTION OF THE DRAWINGS

FIG. 3 is a top plan view schematically illustrating a shutter system of the imaging system of FIG. 2 according to one exemplary embodiment.

FIG. 4A is a fragmentary sectional view schematically illustrating a window and a shutter according to one exemplary embodiment.

FIG. 4B is a fragmentary sectional view of the window and the shutter of FIG. 4A taken along line 4B-4B according to one exemplary embodiment.

FIG. 5 is a fragmentary sectional view schematically illustrating a window and a shutter according to another exemplary embodiment.

FIG. 7 is a fragmentary top perspective view schematically illustrating the shutter system of FIG. 6.

FIG. 8 is a fragmentary sectional view of another embodiment of the imaging system of FIG. 2 including a fourth embodiment of the shutter system taken along line 8-8 of FIG. 9.

FIG. 9 is a fragmentary top perspective view of a shutter system of the imaging system of FIG. 8.

FIG. 10 is a fragmentary sectional view schematically illustrating windows and shutters of the shutter system of FIG. 9 according to one exemplary embodiment.

DETAILED DESCRIPTION OF EXAMPLE EMBODIMENTS

Figure 1:
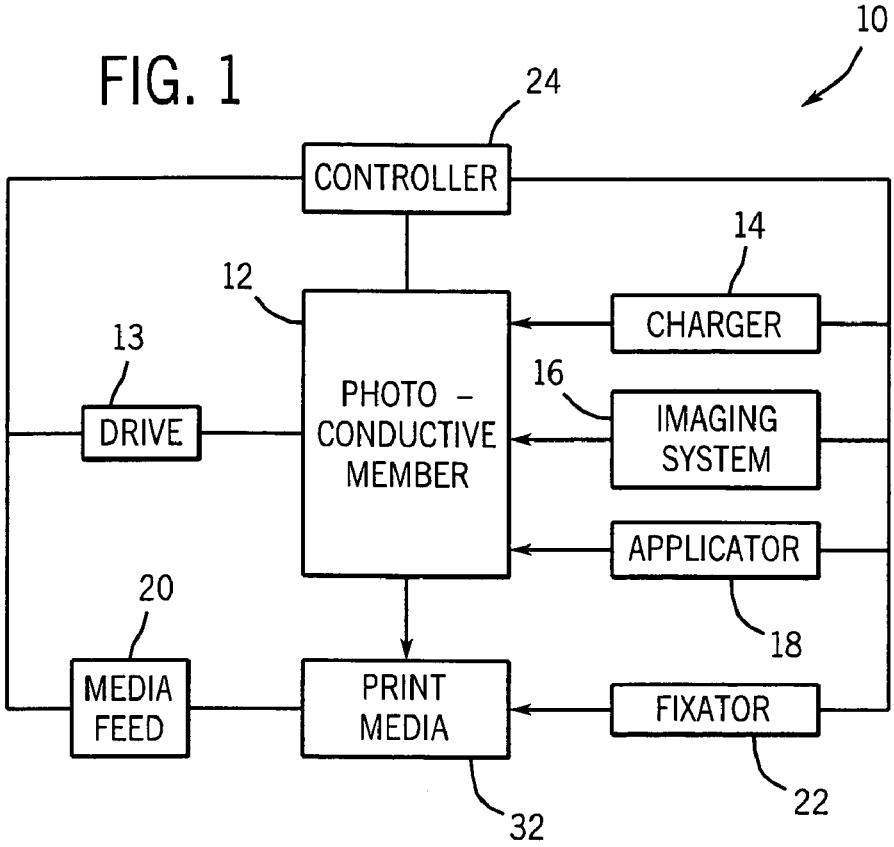
FIG. 1 is a schematic diagram of one example of an image-forming apparatus according to an embodiment of the present invention.

FIG. 1 is a schematic illustration of an image-forming apparatus 10 configured to affix, print or otherwise form an image by depositing printing material upon a surface. In one embodiment, apparatus 10 is configured to deposit or otherwise apply printing material to print media formed from cellulose, polymeric, or other suitable materials. The print media may be in the form of sheets, a roll, or may comprise one or more three-dimensional structures upon which the printing material is to be applied.

Image-forming apparatus 10 generally includes photoconductive member 12, drive 13, charger 14, imaging system 16, applicator 18, media feed 20, fixator 22 and controller 24. Photoconductive member 12, also known as a photo receptor, comprises a member having a surface formed out of photoconductive material, such as a semiconductor, which responds to light by allowing current flow so as to neutralize any positive charge initially imposed upon the surface by charger 14. In one embodiment, a photoconductive member may comprise a drum. In another embodiment, photoconductive member 12 may comprise a belt.

Drive 13 moves the surface of photoconductive member 12 between charger 14, imaging system 16, applicator 18 and print media 32 being driven by media feed 20. In one embodiment in which photoconductive member 12 comprises a drum, drive 13 rotatably drives the drum about an axis. In another embodiment in which the photoconductive member comprises a belt, drive 13 is configured to move the belt about a plurality of tensioning wheels or rollers.

Charger 14 generally comprises a device configured to place a positive charge upon the surface of photoconductive member 12. In one embodiment, charger 14 comprises corona wires which transfer charge to drum 12 in the form of static electricity. In other embodiments, charger 14 may have other configurations.

Imaging system 16 forms an image upon the surface of photoconductive member 12 by selectively directing light at the surface of member 12 to neutralize the positive charge at selected locations along the surface of photoconductive member 12. As will be described in greater detail hereafter, imaging system 16 selectively opens and closes individual windows 26 positioned between light source 28 and the surface 33 (shown in FIG. 2) of photoconductive member 12 by moving the associated shutters 30 (shown in FIG. 2). As a result, imaging system 16 simultaneously directs an array of individual rays or beams of light upon the surface of photoconductive member 12 to form the image upon the surface of photoconductive member 12.

Applicator 18 comprises a device configured to apply a printing material to the surface of photoconductive member 12. In one embodiment, applicator 18 is configured to apply toner to the surface of photoconductive member 12. The printing material adheres to those portions of the surface of photoconductive member 12 which still have a positive charge, i.e., those portions of the surface that have not had light directed upon them. In one embodiment, applicator 18 may include a developer roller. In other embodiments, other forms of applicators may be utilized.

Media feed 20 generally comprises a device configured to move a print medium, such as a cellulose or polymeric-based sheet of material, relative to photoconductive member 12 such that the printing material is transferred from the photoconductive member to the print medium 32. Media feed 20 may utilize a series of belts, rollers or other structures which engage media 32 to move media 32 along a media path adjacent to photoconductive member 12. In one embodiment, photoconductive member 12 directly transfers the deposited printing material to print media 32. In another embodiment, photoconductive member 12 may indirectly transfer the printing material to print media 32 using one or more intermediate transfer rollers or belts (not shown).

In one embodiment, apparatus 10 additionally includes another charger (not shown) proximate to the print media which creates a negative charge upon the print media so as to pull the printing material from the photoconductive member onto the print media 32. In one embodiment, apparatus 10 may additionally include a discharger (not shown) which discharges the negative charge from the print media 32 once the printing material has transferred to print media 32. In such embodiments, the additional charger and discharger may be provided by corona wires.

Fixator 22 generally comprises a device configured to fixate the printing material to print media 32. In one embodiment, fixator 22 comprises a fuser comprising a pair of heated rollers. As print media 32 passes between the rollers, the print media melts or fuses to print media 32. In other embodiments, other heating devices or other print material fixating devices may be employed by apparatus 10. In some embodiments, fixator 22 may be omitted.

Controller 24 generally comprises a processor unit configured to direct the operation of one or more of the remaining components of apparatus 10. For purposes of the disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 24 is not limited to any specific combination of hardware circuitry and software, nor to any particular source for the instructions executed by the processing unit.

Controller 24 generates control signals which cause drive 13 to move the surface of photoconductive member 12 relative to charger 14, imaging system 16, applicator 18 and print media 32. Controller 24 further generates control signals which direct charger 14 to place a positive charge upon the surface of member 12, which direct imaging system 16 to selectively direct light upon portions of the surface of member 12 and which direct applicator 18 to apply printing material, such as toner, to portions of the surface of member 12. Controller 24 also generates control signals that direct media feed 20 to move print media 32 relative to photoconductive member 12 as the printing material is being transferred to the print media 32 and further directs media feed 20 to move the print media relative to fixator 22 which adheres the printing material to print media 32. Controller 24 generates such control signals based upon image data received from a variety of possible sources including, but not limited to, digital cameras, computers, memory card reading devices and the like.

Figure 2:
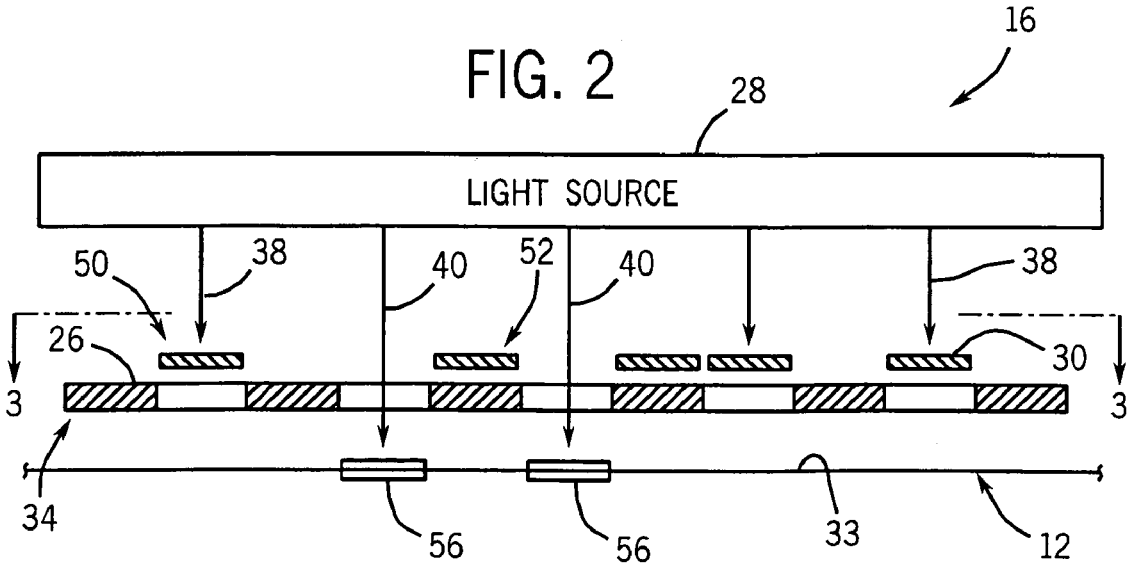
FIG. 2 is a sectional view schematically illustrating an imaging system and a photoconductive member of the image-forming apparatus of FIG. 1 according to one exemplary embodiment.

FIGS. 2 and 3 illustrate imaging system 16 in greater detail. As shown by FIG. 2, imaging system 16 includes light source 28 and shutter system 34. Light source 28 comprises a source of light configured to direct light 38, 40 towards surface 33 of photoconductive member 12. Light source 28 may comprise any suitable source whose wave length and intensity are sufficient to properly expose the material of the photoconductive member. In the particular embodiment illustrated, light source 28 comprises an array of infrared (IR) light emitting diodes (LEDs), such as an array of 625 nm LUXEON STAR HEX side emitting LEDs.

Shutter system 34 includes a multitude of windows 26 and associated shutters 30. As shown by FIG. 3, windows 26 and their associated shutters 30 are arranged in both rows and columns. In other embodiments, windows 26 and shutters 30 may be situated in other arrangements. Windows 26 and their associated shutters 30 are supported between light source 28 and surface 33 of photoconductive member 12 so as to block light 38 or permit light 40 to pass through to surface 33 (shown in FIG. 2). In some embodiments, the shutter system may comprise an array of MEMS-based shutters.

Each window 26 generally includes a frame portion 44 and a light transmissive portion 46. Frame portion 44 extends about light transmissive portion 46 and is configured to support the associated shutter 30. Light transmissive portion 46 is configured to permit light, or at least some portion thereof, to pass through shutter system 34. In one embodiment, light transmissive portion 46 comprises an aperture bound by frame portion 44 such that the light is substantially unaltered as it passes through light transmissive portion 46. In another embodiment, light transmissive portion 46 may comprise a transparent or semi-transparent material through which light or a portion thereof is permitted to pass through. In embodiments wherein light transmissive portion 46 is formed from a transparent or semi-transparent material capable of supporting an associated shutter 30, portions of frame portion 44 may be omitted or frame portion 44 may be omitted in its entirety.

Each shutter 30 comprises one or more structures configured to at least partially block or filter the transmission of light from light source 28. In the particular embodiment shown, each shutter 30 is configured to completely block the transmission of light from light source 28 through a particular window. In the particular embodiment shown, shutters 30 comprise individual panels associated with individual windows 26. As shown by FIGS. 2 and 3, each shutter 30 is configured to move between a window closing position 50 and a window opening position 52. In the window closing position 50, shutter 30 extends across transmissive portion 46 so as to completely cover transmissive portion 46. When in the window closing position, each shutter 30 is supported by a frame portion 44 by any material forming transmissive portion 46 or by forces such as electrical or pneumatic forces. As shown by FIG. 2, when in the window closing position 50, each shutter 30 blocks and prevents light 38 from passing through transmissive portion 46 of the associated window 26. Consequently, this light does not reach surface 33 of photoconductive member 12.

When in the window opening position, each shutter 30 is at least partially removed from its associated window 26, permitting light 40 of light source 28 to pass through transmissive portion 46. In the particular embodiment shown in FIGS. 2 and 3, each shutter 30 is completely removed from transmissive portion 46 of its associated window 26 when in the window opening position. As a result, light 40 is able to pass through substantially the entirety of light transmissive portion 46 onto surface 33. Light 40 which hits surface 33 of photoconductive member 12 causes the semiconductive material of surface 12 to become electrically conductive, discharging the positive charge from particular portions of pixel 56 (hereafter referred to as pixels) of surface 33.

The location of each pixel 56 is in part determined by the location of transmissive portion 26 and positioning of its associated shutter 30. In one embodiment, the dimensions of each pixel 56 is at least in part determined by the size and shape of transmissive portion 46. In particular embodiments, the dimensions of each pixel 56 may also be at least in part based upon the size and shape of the shutter 30 associated with the window providing transmissive portion 46. In the particular example shown, transmissive portion 46 of each window 26 has an area through which light may pass of less than 200 microns. In one embodiment, transmissive portion 46 of each window 26 has an area through which light may pass of less than about 20 microns. The relatively small area of each transmissive portion 46 of each window 26 enables smaller pixels 56 to be formed upon surface 33, enabling higher printing resolutions.

Although transmissive portion 46 of each window 26 is illustrated as being rectangular or square, transmissive portion 46 of each window 26 may have a variety of other shapes and configurations such as circular, triangular, or other suitable shape. Although each of shutters 30 is illustrated as being rectangular or square, each of shutters 30 may have alternative shapes and configurations as well. Although each window 26 has an individual associated shutter 30 that is movable between the window closing position 50 and the window opening position 52 independent of the remaining shutters 30 of other windows 26, particular windows 26 may alternatively share a single shutter 30 that opens or closes both windows 26. Although each of windows 26 and each of shutters 30 are illustrated as being substantially identical to one another, the configuration and arrangement of windows 26 and their associated shutters may alternatively be varied such that one set of windows 26 and shutters 30 have a first configuration and while another set of windows 26 and their associated shutters have a second distinct configuration.

In some embodiments, the controller 24 loads one or more lines of shutter addresses into a buffer (not shown) and then writes the addresses to the shutter system 34 to cause addressed shutters move to or remain at an open position and to permit passage of light from the light source through the associated window toward the photoconductor, thereby writing pixels to the photoconductor. Alternatively, the addressed shutters could move to or remain at a closed position.

FIGS. 4A and 4B are sectional views illustrating a portion of a shutter system 134, one embodiment of shutter system 34. Shutter system 134 includes window 126 and its associated shutter 130. Like window 26, window 126 includes frame portion 44 and transmissive portion 46. Window 126 additionally includes guide 160. Guide 160 is coupled to frame portion 144 and is configured to interact or interface with shutter 130 to guide movement of shutter 130 between the window closing position 50 (shown in solid lines) and the window opening position 52 (shown in broken lines). In the particular example shown, guide 160 directs and aligns movement of shutter 130 in directions indicated by arrows 162 substantially parallel to the general plane of window 126.

As shown in FIG. 4B, according to one embodiment, guide 160 includes a pair of opposing rails 164 which form channels 166. Shutter 130 includes a pair of opposing projections 168 which are slidably disposed within channels 166. Channels 166 and projections 168 cooperate to guide movement of shutter 130. In other embodiments, guide 168 may have other configurations. For example, channel 166 may alternatively be formed as part of shutter 130 while projections 166 are coupled to window 126. In other embodiments, guide 160 may have other configurations.

FIG. 5 is a sectional view illustrating a portion of shutter system 234, another embodiment of shutter system 34 shown in FIGS. 2 and 3. Shutter system 234 includes window 226 and shutter 230. Like window 26, window 226 includes frame portion 44 and transmissive portion 46. Window 226 additionally includes hinge 260 coupled to frame portion 44 and configured to pivotally support shutter 230 for pivotal movement about axis 261 extending generally parallel to the plane of window 226. Hinge 260 enables shutter 230 to pivot in the directions indicated by arrows 262 between the window closing position 50 (shown in solid) and the window opening position 52 (shown in phantom).

In one embodiment, hinge 260 comprises a mechanical hinge in which two distinct members move relative to one another. One example of a mechanical hinge would be a pin passing through a first portion coupled to window 226 and a second portion coupled to shutter 230. Another hinge may include a projection coupled to one of window 226 and shutter 230 and a cavity coupled to the other of window 226 and shutter 230, wherein the cavity receives the projection and wherein the projection or the cavity rotate relative to one another. Yet another hinge may comprise an opening formed within shutter 230 through which a guide structure coupled to window 226 extends, wherein shutter 230 slides along the guide structure during movement between the window closing position 50 and the window opening position 52. In still another embodiment, hinge 260 may comprise a flexible integral hinge known as a "living hinge."

In the particular example shown, shutter 230 pivots about axis 261 through an arc of approximately 180 degrees between the window closing position 50 and the window opening position 52. In the window closing position 52, shutter 230 is removed from transmissive portion 46 of window 226. While in this position, shutter 230 may simultaneously cover or block a transmissive portion 46 of an adjacent window 226 or may extend above frame portion 44 of one or more of windows 226. In other embodiments, shutter 230 may pivot through arcs of less then 180 degrees between the window closing position 50 and the window opening position 52.

Figure 6:
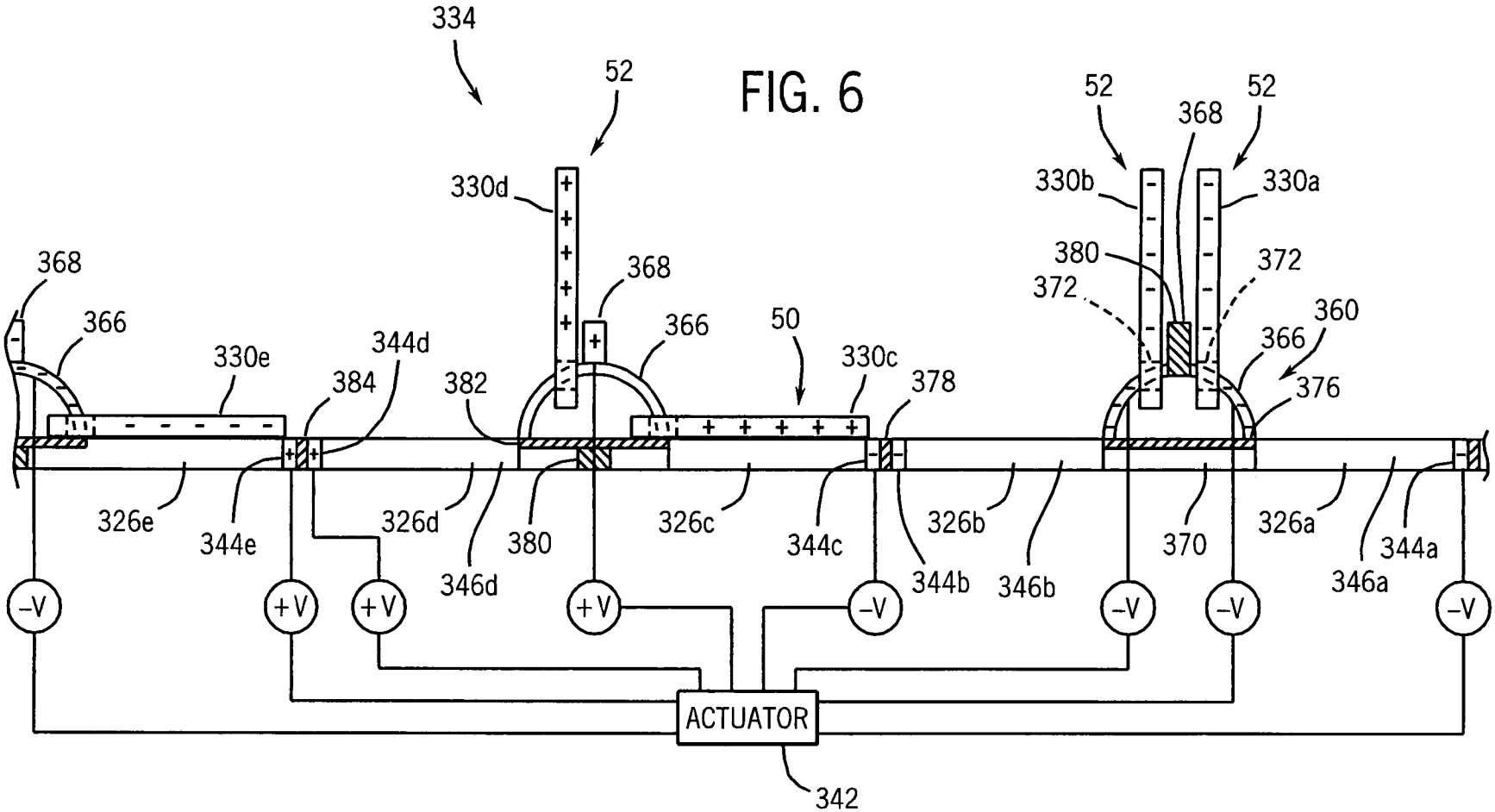
FIG. 6 is a fragmentary sectional view of a fourth embodiment of a shutter system taken along line 6-6 of FIG. 7 according to one exemplary embodiment.

FIGS. 6 and 7 schematically illustrate shutter system 334, another embodiment of shutter system 34 shown in FIGS. 2 and 3. Shutter system 334 includes windows 326*a*, 326*b*, 326*c*, 326*d* and 326*e*, shutters 330*a*, 330*b*, 330*c*, 330*d* and 330*e* and shutter actuator 342. Windows 326*a* and 326*b* include frame portions 344*a* and 344*b* which share a common intermediate portion 370 which supports pivot guide 366 and stop 368. Transmissive portion 346*a* and 346*b* are substantially identical to transmissive portion 46.

Pivot guide 366 is coupled to intermediate portion 370 between transmissive portions 346*a* and 346*b* of windows 326*a* and 326*b*, respectively. In the particular embodiment shown, pivot guide 366 comprises a structure which passes through openings 372 formed within shutters 330*a* and 330*b*. The respective dimensions of pivot guide 366 and openings 372 are configured such that shutters 330*a* and 330*b* slide along pivot guide 366. As a result, pivot guide 366 pivotally supports shutters 330*a* and 330*b* for pivotal movement between window closing positions 50 and window opening positions 52. Because pivot guide 366 pivotally supports both shutters 330*a* and 330*b* between transmissive portions 346*a* and 346*b* of windows 326*a* and 326*b*, respectively, the overall space used for pivotally supporting shutter 330*a* and 330*b* is reduced, enabling a greater number of more compactly arranged windows 326 to increase printing resolution. Because shutters 330*a* and 330*b* share a common pivot guide 366, fabrication costs and materials are further reduced.

Because shutters 330*a* and 330*b* include openings 372 that enable shutters 330*a* and 330*b* to pivot between the window closing position 350 and the window opening position 52 by simply sliding along pivot guide 366, the hinge 360 may be inexpensive to manufacture and may be durable, enabling a greater number of actuations between the window closing position 50 and the window opening position 52. In one embodiment, pivot guide 366 as well as shutters 330*a* and 330*b* are formed utilizing photolithography. An example of a photolithographic method that may be employed to form pivot guide 366 and shutters 330*a* and 330*b* is disclosed in U.S. Pat. No. 6,600,474 to Heines et al., the full disclosure of which is hereby incorporated by reference. In other embodiments, other structure formation techniques may be utilized to form pivot guide 366 and shutters 330*a* and 330*b*.

Although pivot guide 366 is illustrated as extending in an arc so as to be semi-circular, pivot guide 366 may alternatively be semi-rectangular or triangular in shape. Although pivot guide 366 is illustrated as being coupled to intermediate structure 370 at both ends, pivot guide 366 may alternatively be coupled to intermediate portion 370 at only one end. Although shutters 330*a* and 330*b* are illustrated as being pivotally supported by a pair of pivot guides 366, shutters 330*a* and 330*b* may alternatively be supported by a single pivot guide 366 or by greater than two pivot guides 366.

In other embodiments, hinge 360 may comprise other structures configured to pivotally support shutters 330*a* and 330*b* between transmissive portion 346*a* and 346*b*. Moreover, in lieu of shutters 330*a* and 330*b* being pivotally supported by a single hinge 360 which includes pivot guides 366, shutters 330*a* and 330*b* may alternatively be pivotally supported by independent hinge structures between transmissive portions 346*a* and 346*b*. In lieu of such hinge structures comprising one or more pivot guides 366 which extend through apertures 372 of shutters 330*a* and 330*b*, such hinge structures may alternatively comprise other mechanisms such as living hinges, pins or other hinge mechanisms.

Stop 368 generally comprises one or more structures configured to limit pivotal movement of one or both of shutters 330*a* and 330*b*. In the particular embodiment illustrated, stop 368 comprises a structure projecting from pivot guide 366 so as to abut shutters 330*a* and 330*b* as shutters 330*a* and 330*b* are pivoting away from their respective windows 326*a* and 326*b*. In the particular example shown, stop 368 is located so as to abut shutters 330*a* and 330*b* when shutters 330*a* and 330*b* extend substantially perpendicular to windows 326*a* and 326*b*. As a result, shutters 330*a* and 330*b* may be simultaneously actuated to window opening positions 52, wherein shutters 330*a* and 330*b* both extend substantially perpendicular to window 326*a* and 326*b*. Although stop 368 is illustrated as a single structure which engages both shutters 330*a* and 330*b*, stop 368 may alternatively include a first structure which engages and limits pivotal movement of shutter 330*a* and a second structure which engages and limits pivotal movement of shutter 330*b*.

As shown by FIGS. 6 and 7, windows 326*c*, 326*d* and their associated shutters 330*c*, 330*d* are substantially identical to windows 326*a*, 326*b* and shutters 330*a*, 330*b*. However, actuation or movement of shutters 330*a* and 330*b* between the window closing position 50 and the window opening position 52 is performed in a slightly different manner as compared to the actuation or movement of shutters 330*c* and 330*d* between the window closing position 50 and the window opening position 52. In particular, actuator 342 comprises a device configured to selectively apply voltages having different polarities in response to control signals from controller 24 (shown in FIG. 1). Shutters 330*a* and 330*b* are actuated between the window closing position 50 and the window opening position 52 independent of one another by actuator 342 selectively applying voltages having the same or differing polarities to shutters 330*a* and 330*b*. As shown by FIGS. 6 and 7, frame portions 344*a* and 344*b* are not electrically isolated from one another. As a result, frame portion 344*a* and 344*b* have the same charge polarity. At the same time, however, frame portions 344*a* and 344*b* are electrically isolated from shutters 330*a* and 330*b* by insulation layer 376 and are electrically insulated from frame portion 344*c* of window 326*c* by insulation layer 378. Shutters 330*a* and 330*b* are electrically isolated from one another by insulation layer 380 which extends through stop 368 and pivot guide 366. As a result, actuator 342 may apply distinct voltages with distinct polarities to shutters 330*a* and 330*b* independent of the voltage and polarity applied to frame portions 344*a* and 344*b*. In the particular example shown in FIG. 7, actuator 342 is applying a voltage with a negative polarity to frame portions 344*a* and 344*b* and is independently applying voltages with negative polarities to shutters 330*a* and 330*b*. Due to the common polarities of the charges, shutters 330*a* and 330*b* are both repelled away from transmissive portions 346*a* and 346*b* against stop 368 to the window opening positions 52 shown. To alternatively actuate shutter 330*a* to the window closing position 50, actuator 342 may alternatively apply a voltage with a positive polarity to shutter 330*a*, wherein the opposite polarities of frame portion 344*a* and shutter 330*a* will cause shutter 330*a* to be attracted to frame portion 340*a* so as to pivot shutter 330*a* to a window closing position 50. To simultaneously move both shutters 330*a* and 330*b* to window closing positions 50, actuator 342 may alternatively apply a voltage with a positive polarity to frame portions 344*a* and 344*b* which would cause shutters 330*a* and 330*b* to simultaneously pivot so as to extend over transmissive portion 346*a* and 346*b*, respectively.

Shutters 330*c* and 330*d* are independently actuated between the window closing position and the window opening position 52 by actuator 342 independently applying voltages having different polarities to frame portions 344*c* and 344*d*. As shown by FIG. 6, shutters 330*c* and 330*d* are not electrically isolated from one another and have a common charge polarity. In contrast, frame portions 344*c* and 344*d* are electrically isolated from one another by insulation layer 380, are insulated from shutters 330*c* and 330*d* by insulation layer 382 and are electrically insulated from adjacent windows by insulation layer 384. As a result, actuator 342 may apply voltages having different polarities to frame portions 344*c* and 344*d* independent of the voltage and charge polarity applied to shutters 330*c* and 330*d*. In the particular example shown in FIG. 7, actuator 342 is applying a voltage with a positive polarity to shutters 330*c* and 330*d*. At the same time, actuator 342 is applying a voltage with a negative polarity to frame portion 344*c* and with a positive polarity to frame portion 344*d*. The opposite polarities of the voltages applied to frame portion 344*c* and shutter 330*c* create electrostatic forces which attract shutter 330*c* towards frame portion 344*c* so as to pivot shutter 330*c* to the window closing position 50 shown. At the same time, the common polarities of frame portion 344*d* and of shutter 330*d* have electrostatic forces which repel shutter 330*d* away from transmissive portion 346*d* of window 326*d* against stop 368 to the window opening position 52 shown. To alternatively reposition both shutters 330*c* and 330*d*, actuator 342 may apply a voltage with an opposite polarity (i.e., a negative polarity) to shutters 330*c* and 330*d*. To individually move one of shutters 330*c*, 330*d* while maintaining the other of shutters 330*c*, 330*d* in its current position, actuator 342 may reverse the polarity of the charge being applied to either frame portion 344*c* or frame portion 344*d*.

Although shutters 330*a* and 330*b* are illustrated as being selectively movable between the window closing position 50 and the window opening position 52 by independently controlling the polarity of the charge or voltage applied to shutters 330*a* and 330*b* and although shutters 330*c* and 330*d* are illustrated as being actuatable between the window closing position 50 and the window opening position 52 by selectively applying potentially different charge polarities to frame portions 344*c* and 344*d*, each of shutters 330*a*-330*d* may alternatively be controlled by varying the polarity of the charges applied to the shutters themselves or by varying the polarity of the charges applied to the frame portions of their respective windows. In particular embodiments, frame portions sharing a common intermediate portion may be electrically isolated and those shutters supported by intermediate portion may be electrically isolated from one another such that actuation of the shutters may be achieved by applying voltages with distinct polarities to the frame portions, to the shutters or to both the shutters and frame portions. In still other embodiments, actuator 342 may utilize other means for moving the shutters between the window closing position 50 and the window opening position 52.

FIGS. 8 and 9 illustrate imaging system 416, another embodiment of imaging system 16 shown in FIG. 1. Imaging system 416 includes light source 28, shutter system 434 and optics 490. Light source 28 is described above with respect to FIG. 2. Like shutter system 34, 134, 234 and 334, shutter system 434 includes a multitude of windows 426 which are selectively opened and closed by individually moving associated shutters 430 between window closing positions 50 and window opening positions 52. When shutters 430 are in the window closing position 50, light 38 is blocked and prevented from reaching surface 33 of photoconductive member 12, illustrated as extending along an arc. Those shutters 430 that are in the window opening position 52 permit light 40 to pass through transmissive portions of windows 426 towards surface 33. In the particular example shown in FIG. 8, surface 33 is arcuate. Optics 490 comprises one or more lenses, situated between shutter system 434 and surface 33. Light 40 passing through shutter system 434 is further re-directed by optics 490 prior to reaching surface 33 and forming pixels 56.

FIGS. 9 and 10 illustrate shutter system 434 in greater detail. As shown by FIG. 9, each window 426 is electrically isolated from adjacent windows 426 by insulation layers 478. Each window 426 includes frame portion 444 and transmissive portion 446. Frame portion 444 is a C-shaped member including base 447 and legs 449 which, together, bound three sides of transmissive portion 446. Base 447 further bounds transmissive portion 446 of an adjacent window 426. Each shutter 430 is pivotally coupled to its associated window 426 on one side of the transmissive portion 446 of the associated window 426. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

As shown by FIG. 10, each shutter 430 is pivotally coupled to its associated window 426 by hinge 460. Hinge 460 is similar to hinge 360 except that hinge 460 pivotally supports only a single shutter 430. Hinge 460 includes pivot guide 366 and stop 368. Shutter 430 includes aperture 372, enabling shutter 430 to freely pivot as it slides along and is guided by pivot guide 366. In other embodiments, hinges 430 may be pivotally coupled to their associated windows 426 by other hinge mechanisms.

As shown by FIG. 10, shutter system 434 additionally includes actuator 442 for selectively actuating shutters 430 between the window closing position 50 and the window opening position 52. Actuator 442 creates electrostatic forces to pivot or retain shutters 430. In the example shown in FIG. 10, actuator 442 supplies a voltage with a first positive polarity to window 426*a*. Because frame portion 444*a*, hinge 460*a* and shutter 430*a* are not electrically isolated from one another, each has the same charge with the same positive polarity. Actuator 442 transmits a voltage having the same positive polarity to a consecutive, or adjacent, window 426*b* opposite hinge 460*a*. Because shutter 430*a* and window 426*b* have the same polarity, shutter 430*a* is repelled away from window 426*b* against stop 368 to the window opening position 52. To move shutter 430*a* to the window closing position 50, actuator 442 may alternatively apply a voltage with a negative polarity to window 426*b*. In such an alternative scenario, shutter 430*a* is attracted towards window 426*b* so as to pivot to the window closing position 50.

In the example shown in FIG. 10, actuator 442 is applying a voltage with a positive polarity to window 426*b*. Actuator 442 is also applying a voltage with a negative polarity to the next consecutive window 426*c* which is opposite to hinge 460*b* of window 426*b*. Due the differing polarities of windows 426*c* and 426*b*, shutter 430*a* is attracted towards window 426*c* and towards the window closing position 50 shown. In the particular embodiment illustrated, the attractive electrostatic force is sufficient to hold or elevate shutter 430*b* over transmissive portion 446 of window 426*b* which comprises an aperture. In other embodiments, transmissive portion 446 may be composed of a transparent or semi-transparent material which assist in supporting shutter 430*b* in the window closing position or an additional support or ledge may be provided between transmissive portion 446 of window 426*b* and window 426*c*.

As shown by FIG. 10, in response to control signals from controller 24 (shown in FIG. 1), actuator 442 varies the polarity of the voltages applied to consecutive windows to cause pivotal movement of shutters 430 between the window closing position 50 and the window opening position 52. Because the transmissive portion 446 of each window 426 is in part bounded by frame portion 444 of an adjacent window 426, the overall size of each window 426 is reduced, enabling windows 426 to be more compactly arranged and providing satisfactory printing resolution.

Overall, embodiments of image-forming apparatus 10 are capable of forming images upon a print medium quickly and quietly. Rather than forming an image upon the photoconductive member one line at a time, some embodiments of imaging system 16, 416 simultaneously form multiple lines of pixels or images upon surface 33 of photoconductive member 12. Because image-forming apparatus 10 forms such images upon photoconductive member 12 by physically moving shutters between window closing positions 50 and window opening positions 52, light is selectively directed upon the surface 33 of the photoconductive member 12 to form such images in a time efficient manner without using relatively expensive liquid crystal members that use polarized light.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. An image-forming apparatus comprising:

a light source;

a photoconductive member; and one or more shutters disposed between the light source and the photoconductive member to selectively permit light from the light source to pass toward the photoconductive member, wherein each shutter pivots between a light interfering position and a non-interfering position.

2. The apparatus of claim 1, including a first window having a first transmissive portion and a second window having a second transmissive portion and wherein the shutters include a first shutter for the first window and a second shutter for the second window, the first shutter and the second shutter being located between the first transmissive portion and the second transmissive portion.

3. The apparatus of claim 2, wherein the first shutter and the second shutter are pivotally supported between the first transmissive portion and the second transmissive portion.

4. The apparatus of claim 3, wherein the first shutter and the second shutter are configured to pivot independent of one another.

5. The apparatus of claim 1, including a first window and a second window and wherein the shutters include a first shutter configured to pivot between a first position in which the first window is closed and the second window is open and a second position in which the first window is open and the second window is closed.

6. The apparatus of claim 1 including windows between the light source and the photoconductive member, wherein each shutter pivots between a first position parallel to the windows and a second position perpendicular to the windows.

7. The apparatus of claim 1 including windows between the light source and the photoconductive member, wherein the windows are arranged in rows.

8. The apparatus of claim 7, wherein the windows are arranged in columns.

9. The apparatus of claim 1 including an applicator configured to deposit a printing material upon the photoconductive member.

10. The apparatus of claim 9, wherein the material comprises toner.

11. The apparatus of claim 1 including a drive configured to move print media relative to the photoconductive member.

12. The apparatus of claim 1 including optics between the shutters and the photoconductive member.

13. The apparatus of claim 1, wherein the photoconductive member comprises a drum.

14. The apparatus of claim 1, wherein each shutter includes an opening through which a pivot guide extends.

15. The apparatus of claim 1 including windows between the light source and the photoconductive member, wherein each window has a transmissive portion having an area of less than 200 microns.

16. The apparatus of claim 1 including windows between the light source and the photoconductive member, wherein each window has a transmissive portion having an area of less than 20 microns.

17. The apparatus of claim 1 including windows between the light source and the photoconductive member, wherein each window forms an aperture.

18. The apparatus of claim 1 including windows between the light source and the photoconductive member, wherein the windows have a maximum density of 1200 windows per square inch.

19. The apparatus of claim 1 including windows between the light source and the photoconductive member and at least one voltage source configured to apply a first charge having a first polarity to one of the shutters and a second charge having a second polarity opposite to the first polarity to one of the windows adjacent said one of the shutters.

20. The apparatus of claim 1 including windows between the light source and the photoconductive member and at least one voltage source configured to apply a first charge having a first polarity to one of the shutters and a second charge having the same polarity as the first charge to one of the windows adjacent said one of the shutters.

21. The apparatus of claim 1 including windows between the light source and the photoconductive member, wherein each shutter pivots between the closing position and the opening position and wherein the apparatus includes a stop configured to limit pivotal movement of one of the shutters away from an adjacent one of the windows.

22. The apparatus of claim 1 including a first window and a second window and wherein the first window and the second window are electrically insulated from one another.

23. The apparatus of claim 1, wherein the shutters include a first shutter and a second shutter and wherein the first shutter and the second shutter are electrically insulated from one another.

24. The apparatus of claim 23 including a first window and a second window, wherein the first shutter and the second shutter are pivotally supported between the first window and the second window.

25. The apparatus of claim 1 including a first window and wherein the shutters include a first shutter adjacent the first window, wherein the first shutter and the first window are electrically insulated from one another.

26. The apparatus of claim 1 including an actuator configured to move each shutter between a light interfering position and a light non-interfering position.

27. The apparatus of claim 26, wherein the actuator is configured to move each shutter between the light interfering position and the light non-interfering position using electrostatic forces.

28. The apparatus of claim 1 including windows between the light source and the photo conductive member, wherein each of the windows has an associated one of the shutters and wherein the apparatus includes an actuator configured to move the shutters between a window closing position and a window opening position by selectively applying charge to adjacent windows.

29. The apparatus of claim 1 further comprising a first window and a second consecutive window, wherein the shutters include a first shutter for the first window on a first side of the second window and a second shutter for the second window on a second side of the second window.

30. The apparatus of claim 29 wherein the first window includes an opening and wherein the first shutter is configured to be cantilevered over the opening.

31. A shutter device comprising:

a first window;

a second window;

a first shutter for selectively covering the first window pivotally supported between the first window and the second window; and a second shutter for selectively covering the second window pivotally supported between the first window and the second window, wherein the first shutter and the second shutter are configured to be simultaneously held in positions in which the first window and the second window are uncovered.

32. A shutter device comprising:

a first window;

a shutter associated with the first window and configured to move between a window closing position and a window opening position, wherein the first window and the shutter are not electrically isolated from one another;

a second window adjacent the first window; and an actuator configured to selectively apply charge to the first window and the second window to move the shutter between the window opening position and the window opening position.

33. A method for forming an image upon a print medium, the method comprising:

charging a photoconductive surface;

opening or closing windows by moving associated shutters; and directing light through the windows that are open onto the photoconductive surface.

34. The method of claim 33 including applying a printing material to the photoconductive surface.

35. The method of claim 34 including transferring the printing material from the photoconductive surface to the print medium.

36. The method of claim 33 including pivoting the shutters to open and close their associated windows.

37. The method of claim 33 including sliding the shutters to open and close their associated windows.

38. The method of claim 33, wherein each window and its associated shutter are electrically isolated from one another.

39. The method of claim 33 including:

applying a first charge having a first polarity to one of the windows; and applying a second charge having a second opposite polarity to one of the shutters associated with said one of the windows.

40. The method of claim 33 including:

applying a first charge having a polarity to one of the windows; and applying a second charge having the same polarity to one of the shutters associated with said one of the windows.

41. The method of claim 33 including:

pivoting at least one of the shutters to a position substantially perpendicular to its associated window.

42. The method of claim 33, wherein the windows include a first window and a second window, wherein the shutters associated with the first window and the second window are pivotally supported between the first window and the second window and wherein the method includes simultaneously opening the first window and the second window.

43. An image-forming apparatus comprising:

a light source;

a photoconductive member;

windows between the light source and the photoconductive member; and means for selectively covering and uncovering the windows.

44. A micro electromechanical (MEMs) shutter system comprising:

a structure having a micro-window and one of a channel and a projection along the window; and a shutter including the other of the channel and the projection, wherein the projection is slideably received within the channel to slideably guide the shutter between the window closing position and the window opening position.

45. The system of claim 44 wherein the projection is associated with the shutter.

46. An image-forming apparatus comprising:

a light source;

a photoconductive member;

one or more shutters disposed between the light source and the photoconductive member to selectively permit light from the light source to pass toward the photoconductive member; and windows between the light source and the photoconductive member, wherein each window has a transmissive portion having an area of less than 200 microns.

47. An image-forming apparatus comprising:

a light source;

a photoconductive member; and one or more shutters disposed between the light source and the photoconductive member to selectively permit light from the light source to pass toward the photoconductive member, wherein each shutter slides between a light interfering position and a non-interfering position.

48. The apparatus of claim 47 including an actuator configured to move each shutter between a light interfering position and a light non-interfering position.

49. The apparatus of claim 48, wherein the actuator is configured to move each shutter between the light interfering position and the light non-interfering position using electrostatic forces.

* * * * *

UNITED STATES PATENT AND TRADEMARK OFFICE

CERTIFICATE OF CORRECTION

PATENT NO. : 7,277,107 B2
APPLICATION NO. : 10/916690
DATED : October 2, 2007
INVENTOR(S) : Dale R. Kopf et al.

It is certified that error appears in the above-identified patent and that said Letters Patent is hereby corrected as shown below:

In column 12, line 54, in Claim 28, delete "photo conductive" and insert -- photoconductive --, therefor.

Signed and Sealed this

Fifth Day of August, 2008

JON W. DUDAS
*Director of the United States Patent and Trademark Office*